United States Patent [19]

Shelby

[11] Patent Number: 4,796,304

[45] Date of Patent: Jan. 10, 1989

[54] VENTILATED HUNTING CLOTHING

[76] Inventor: Earl Shelby, 209 N. Linn St., Glenwood, Iowa 51534

[21] Appl. No.: 110,673

[22] Filed: Oct. 19, 1987

[51] Int. Cl.[4] ..... A41D 1/00

[52] U.S. Cl. ..... 2/94; 2/102; 2/247

[58] Field of Search ..... 2/104, 94, 102, 46, 2/DIG. 1, 247

[56] References Cited

U.S. PATENT DOCUMENTS

| | | | |
|---|---|---|---|
| 2,448,416 | 8/1948 | Carter | 2/94 |
| 2,678,447 | 5/1954 | Bracken | 2/94 |
| 2,755,480 | 0/1956 | Jones et al. . | |
| 2,796,208 | 6/1957 | O'Leary et al. | 2/102 |
| 4,723,695 | 2/1988 | Farber | 2/94 |

OTHER PUBLICATIONS

Keleher Pharmacy Catalog, page from 1977 catalog.

*Primary Examiner*—Ronald Feldbaum
*Attorney, Agent, or Firm*—James D. Welch

[57] ABSTRACT

A hunting apron or vest which is comprised of a base material which is cut and fashioned into the general overall shape of the apron or vest, to which, over a substantial majority of the outer surface, is loosely attached a net-like mesh material. The purpose of the loosely attached mesh material is to form pockets into which game, food, equipment and other items can be carried while a hunter, or other user, wears the apron or vest.

3 Claims, 1 Drawing Sheet

VENTILATED HUNTING CLOTHING

The subject matter of this invention is disclosed in Disclosure Document number 170492.

TECHNICAL FIELD

This invention relates to hunting clothing and in particular to hunting aprons and vests with large ventilated pocket-like structures which are formed between net-like mesh material and a fabric base material.

BACKGROUND OF THE INVENTION

Various inventors have obtained patents on hunting vests which provide beneficial features. A patent to Bracken, U.S. Pat. No. 2,678,447 for instance, provides for a game pocket which mounts to a coat by means of slide fasteners. A patent to Jones et. al., U.S. Pat. No. 2,755,480 also provides for pockets and focuses on double pocket construction with emphasis on use of water and blood proof materials. A patent to Salsby, U.S. Pat. No. 3,885,248 teaches a hunting vest constructed from a combination of a fabric on the back and a mesh material on the front.

While the indicated patents teach inventions that use fabric and mesh materials, and that teach inclusion of pockets in hunting clothing, none teach a hunting apron or vest which is constructed to allow many items to be carried in large ventilated pocket-like structures. No reference of which the inventor is aware teaches hunting clothing which is constructed from a fabric base and a loosely attached net-like mesh material, in a fashion such that ventilated pocket-like structures are formed between the fabric base material and the net-like mesh material in which items can be securely placed by a hunter or other user who is wearing the hunting clothing, the purpose being to allow air to ventilate the items and prevent items such as food from becoming soggy and stale when so placed, as can occur in non-ventilated pockets.

A need exists for hunting clothing which provides large ventilated pocket-like structures in which can be carried game, food and equipment etc., so that such items as game and food will have access to freshness preserving ventilation when carried in the large pocket-like structures by a hunter or other user who is wearing the hunting clothing.

DISCLOSURE OF THE INVENTION

The present invention meets the need identified in the Background Section. The hunting apron and vest of the present invention comprise a fabric base material which forms the apron or vest, upon which apron or vest is loosely attached a net-like mesh material in a fashion such that large ventilated pocket-like structures are formed between the fabric base material and the net-like mesh material. Openings are provided through which items can be placed between the net-like mesh material and the fabric base material and carried by a hunter or other user who is wearing the clothing. The mesh material allows ventilation to occur, which ventilation serves to keep items such as food and game in a fresh condition, (e.g. not soggy as can occur in liquid tight pouch-type pockets).

SUMMARY OF THE INVENTION

Experience of the Inventor, and investigation of existing hunting clothing shows that a need exists for hunting clothing which provides large ventilated pocket-like structures in which items, such as food and game and equipment, can be carried by a user wearing the clothing without becoming degraded in quality due to lack of ventilating air access. The present invention meets the need by providing hunting clothing (e.g. aprons or vests) constructed from a fabric base material, to which is loosely attached net-like mesh material to form large ventilated pocket-like structures. Also included are openings through which items can be placed into the large pocket-like structures formed between the net-like mesh material and the fabric base material. Conventional pockets might also be included in the apron or vest.

A purpose of the present invention is to provide hunters and other users with a hunting apron or vest which includes large pocket-like structures in which many items such as game, food or equipment (e.g. shells, camera, cigarettes, hiking and camping apparatus etc.), can be placed while the hunting apron or vest is worn by a user.

Another purpose of the present invention is to provide a hunting apron or vest with large ventilated pocket-like structures which are formed between the fabric base material and net-like mesh material, which net-like mesh material allows air to pass through and ventilate items stored in the large ventilated pocket-like structures, which ventilation serves to keep items such as game and food in a fresh condition.

DETAILED DESCRIPTION

Figure 3:
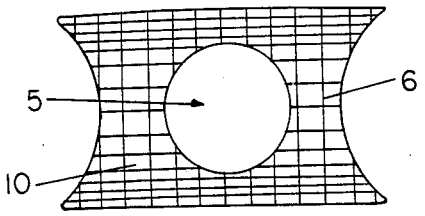
FIG. 3 shows a ventilated hunting apron in top view.
Figure 1:
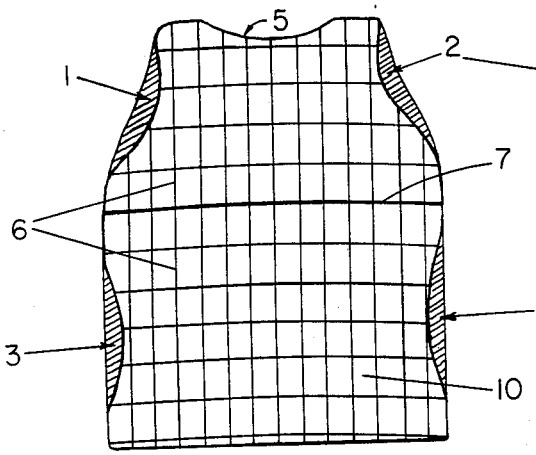
FIG. 1 shows a ventilated hunting apron in front view.
Figure 2:
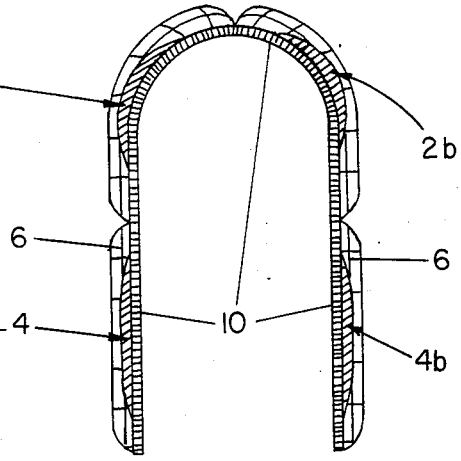
FIG. 2 shows a ventilated hunting apron in opened side view.

Referring now to FIGS. 1 and 2 there is shown a hunting apron comprised of a fabric base material (10) which is cut to the pattern of and assembled into an apron. FIG. 1 shows that the fabric base material (10) is visible through the net-like mesh material (6), which net-like mesh material (6) is firmly attached to the fabric base material (10) at the edges of the apron, and, perhaps, along a locus such as defined by the line indicated by (7). The net-like mesh material (6) is otherwise loosely situated atop of the fabric base material (10). Openings (1) (2) (3) (4) (**2*b*) and (4*b*) allow a hunter, or other user who is wearing the hunting apron, to place items such as game, food, or equipment etc., between the net-like mesh material (6) and the fabric base material (10), for ventilated storage. FIGS. 1 and 3 show the hole in the hunting apron (5**) which goes over a hunter's or other user's head. A waist band or belt (not shown) can be used with the hunting apron to keep it in place during use.

Figure 4:
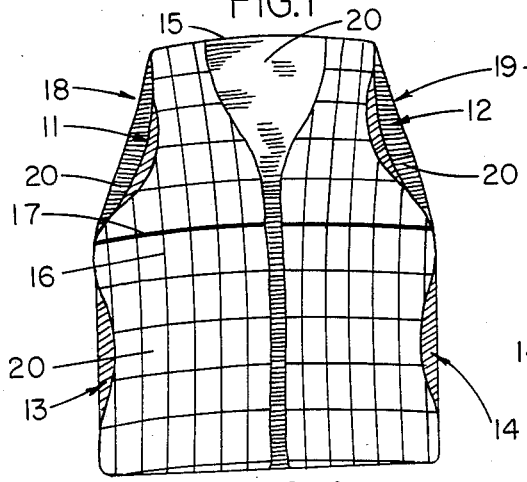
FIG. 4 shows a ventilated hunting vest in front view.
Figure 5:
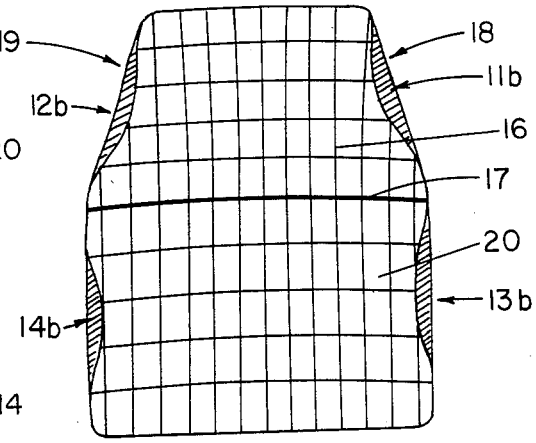
FIG. 5 shows a ventilated hunting vest in back view.
Figure 6:
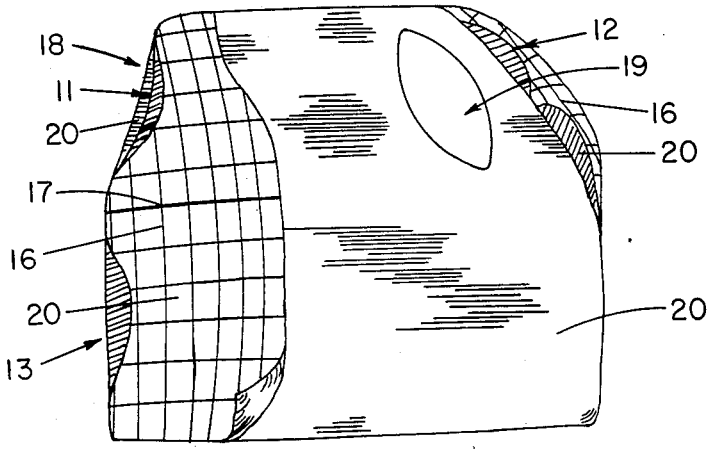
FIG. 6 shows a ventilated hunting vest in front view with one side opened.

FIGS. 4 through 6 show a hunting vest. A fabric base material (20) is cut to the pattern of and assembled into a vest, and net-like mesh material (16) is attached to the vest at the edges thereof and, perhaps, along a locus as defined by the line identified by (17). Openings (11) (12) (13) (14) (**11*b*) (12*b*) (13*b*) (14*b*) allow a hunter or other user to place items such as game and food or equipment between the net-like mesh material (16) and the fabric base material (20) for ventilated storage. Arm holes (18) and (19) and neck hole (15**) are also shown.

Connectors such as snaps or zippers (not shown) can be attached to the front of the ventilated hunting vest to allow closing it around a hunter or other user when worn by same.

The hunting apron or vest can be made in any color or combination of colors for safety or artistic and aesethetic reasons.

The fabric base material and the net-like mesh material can be of any useable substance(s) chosen for heat conservation, moisture resistance or elasticity etc.

The hunting apron or vest can be worn inside-out, for instance when the fabric base material is moisture proof or resistant and the hunter or other user is wearing the clothing in the rain and wishes to keep the game, food or equipment etc. between the net-like mesh material and the fabric base material dry.

Users other than hunters might include construction workers, highway engineers, railroad employees, farmers and ranchers etc.

Having hereby disclosed the subject matter of this invention, it should be obvious that many modifications, substitutions, and variations of the present invention are possible in light of the teachings. It is therefore to be understood that the invention may be practiced other than as specifically described, and should be limited in breadth and scope only by the claims.

I claim:

1. A hunting vest or the like comprising;

(a) a base fabric material, (b) a net-like mesh material;

(c) said net-like mesh material covering the outside surfaces of said hunting vest and being attached to said base fabric material along the edges thereof except at selected edge portions and at other loci thereby forming openings thereat and pocket like structures in said vest or the like between said base fabric material and said net-like mesh material.

2. A hunting vest of the like as in claim 1, in which the base fabric material is moisture resistant.

3. A hunting vest or the like as in claim 1, in which the base fabric material is heat conservative.

* * * * *